United States Patent [19]

Kim et al.

[11] 4,101,414

[45] Jul. 18, 1978

[54] REREFINING OF USED MOTOR OILS

[75] Inventors: Yang J. Kim, Villa Park; Belton R. Williams, Naperville, both of Ill.

[73] Assignee: Unitech Chemical Inc., Chicago, Ill.

[21] Appl. No.: 609,183

[22] Filed: Sep. 2, 1975

[51] Int. Cl.[2] ..... C10G 7/00; C10M 11/00

[52] U.S. Cl. ..... 208/18; 208/19; 208/184; 208/185

[58] Field of Search ..... 208/179, 184, 18, 19, 208/185

[56] References Cited

U.S. PATENT DOCUMENTS

| | | | |
|---|---|---|---|
| 2,018,778 | 10/1935 | Ebner | 208/184 |
| 2,076,498 | 4/1937 | Farwell | 208/184 |
| 3,639,229 | 2/1972 | Brownawell et al. | 208/184 |
| 3,791,965 | 2/1974 | Fitzsimons et al. | 208/179 |
| 3,919,076 | 11/1975 | Cutler et al. | 208/184 |

*Primary Examiner*—Herbert Levine

*Attorney, Agent, or Firm*—Edward T. McCabe; Charles E. Bouton; Jay C. Langston

[57] ABSTRACT

Screened and drained used lubricating oil stock is predistilled in a steam stripping still for about 4 hours or more. The thus predistilled used oil then flows to an evaporator for a vacuum distillation at a temperature below the cracking temperature of the stock, about 480°-650° F., to effect an evaporation of the used lubricating oil and its separation from a concentrate by-product of heavy lube hydrocarbons and additives.

13 Claims, 3 Drawing Figures

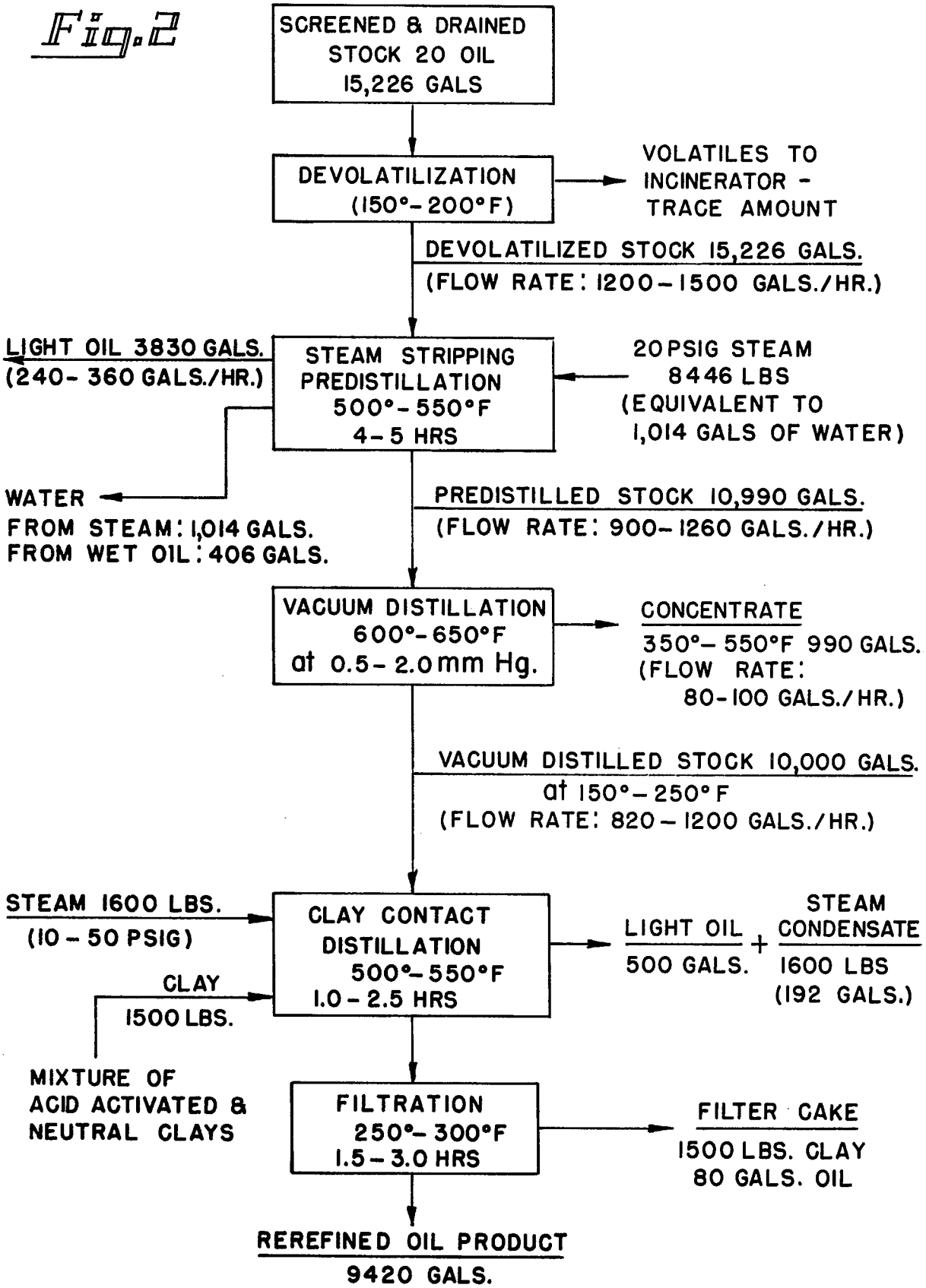
Fig. 2
SCREENED & DRAINED STOCK 20 OIL 15,226 GALS
DEVOLATILIZATION (150°-200°F)
VOLATILES TO INCINERATOR - TRACE AMOUNT
DEVOLATILIZED STOCK 15,226 GALS.
(FLOW RATE: 1200-1500 GALS./HR.)
LIGHT OIL 3830 GALS.
(240-360 GALS./HR.)
STEAM STRIPPING PREDISTILLATION 500°-550°F 4-5 HRS
20 PSIG STEAM 8446 LBS (EQUIVALENT TO 1,014 GALS OF WATER)
WATER
FROM STEAM: 1,014 GALS.
FROM WET OIL: 406 GALS.
PREDISTILLED STOCK 10,990 GALS.
(FLOW RATE: 900-1260 GALS./HR.)
VACUUM DISTILLATION 600°-650°F at 0.5-2.0 mm Hg.
CONCENTRATE
350°-550°F 990 GALS.
(FLOW RATE: 80-100 GALS./HR.)
VACUUM DISTILLED STOCK 10,000 GALS.
at 150°-250°F
(FLOW RATE: 820-1200 GALS./HR.)
STEAM 1600 LBS.
(10-50 PSIG)
CLAY 1500 LBS.
MIXTURE OF ACID ACTIVATED & NEUTRAL CLAYS
CLAY CONTACT DISTILLATION 500°-550°F 1.0-2.5 HRS
LIGHT OIL 500 GALS. + STEAM CONDENSATE 1600 LBS (192 GALS.)
FILTRATION 250°-300°F 1.5-3.0 HRS
FILTER CAKE
1500 LBS. CLAY
80 GALS. OIL
REREFINED OIL PRODUCT
9420 GALS.

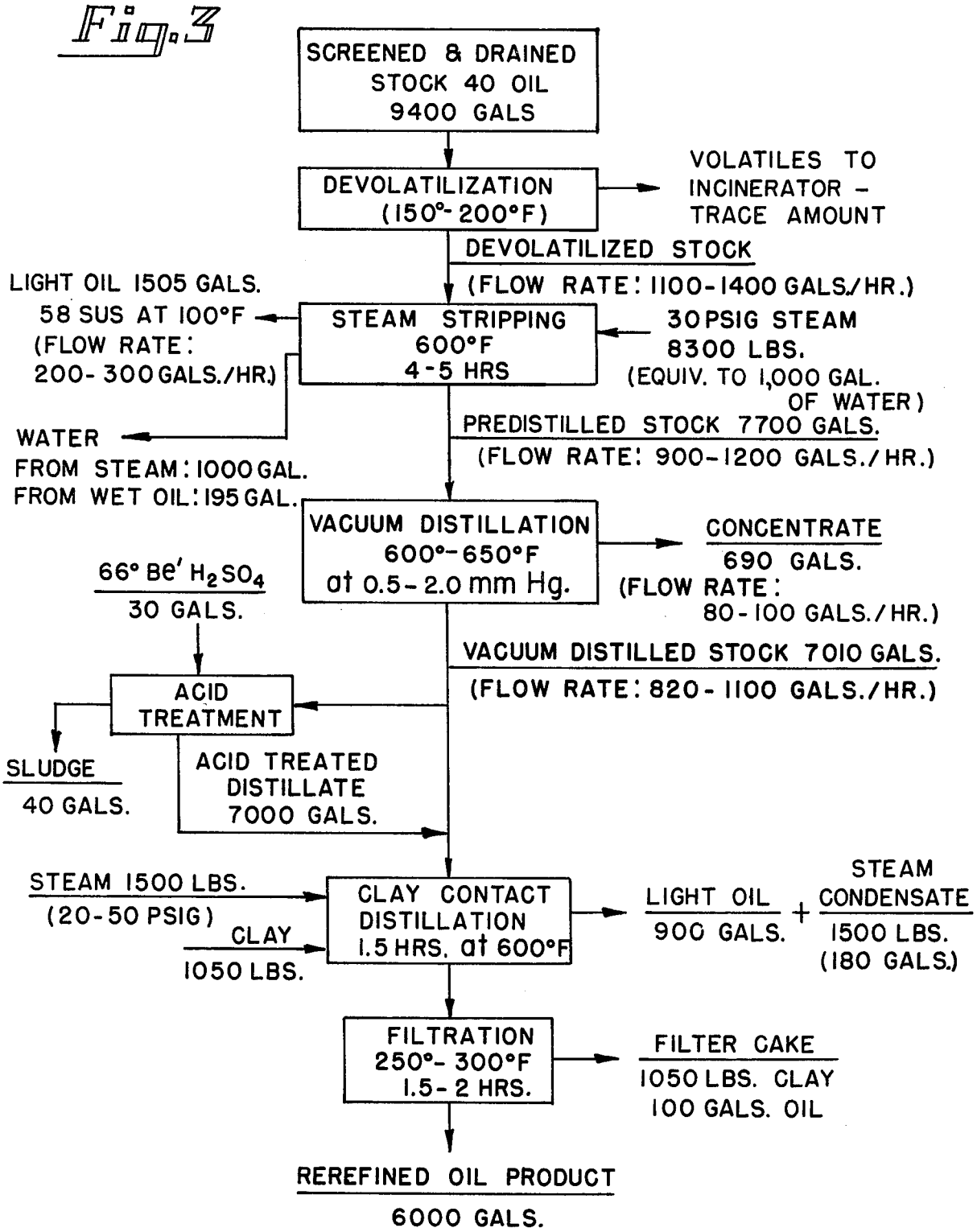
Fig. 3
SCREENED & DRAINED STOCK 40 OIL 9400 GALS
DEVOLATILIZATION (150°-200°F)
VOLATILES TO INCINERATOR - TRACE AMOUNT
DEVOLATILIZED STOCK
(FLOW RATE: 1100-1400 GALS./HR.)
LIGHT OIL 1505 GALS.
58 SUS AT 100°F
(FLOW RATE: 200-300 GALS./HR.)
STEAM STRIPPING 600°F 4-5 HRS
30 PSIG STEAM 8300 LBS.
(EQUIV. TO 1,000 GAL. OF WATER)
WATER
FROM STEAM: 1000 GAL.
FROM WET OIL: 195 GAL.
PREDISTILLED STOCK 7700 GALS.
(FLOW RATE: 900-1200 GALS./HR.)
VACUUM DISTILLATION 600°-650°F at 0.5-2.0 mm Hg.
CONCENTRATE
690 GALS.
(FLOW RATE: 80-100 GALS./HR.)
66° Be' $H_2SO_4$
30 GALS.
VACUUM DISTILLED STOCK 7010 GALS.
(FLOW RATE: 820-1100 GALS./HR.)
ACID TREATMENT
SLUDGE
40 GALS.
ACID TREATED DISTILLATE 7000 GALS.
STEAM 1500 LBS.
(20-50 PSIG)
CLAY
1050 LBS.
CLAY CONTACT DISTILLATION 1.5 HRS. at 600°F
LIGHT OIL
900 GALS.
+
STEAM CONDENSATE
1500 LBS.
(180 GALS.)
FILTRATION 250°-300°F 1.5-2 HRS.
FILTER CAKE
1050 LBS. CLAY
100 GALS. OIL
REREFINED OIL PRODUCT
6000 GALS.

REREFINING OF USED MOTOR OILS

This invention relates to the rerefining of used lubricating oil stocks by removal of impurities from such used stocks and includes a method and means for effecting an evaporation at extremely low pressures to separate the stock into a clarified lubricating oil and a useful concentrate by-product.

In the rerefining of used lubricating oils, there has long been sought a process and apparatus that will continuously and efficiently remove impurities from used lubricating oil stocks, while avoiding the significant problems of coking, fouling and corroding of the apparatus; cracking of the lubricating stock into lighter, less valuable oils; and inconsistent effectiveness of rerefining operations in general.

Prior art rerefining operations have been known to use vacuum distillation techniques. For example, there are currently in use some vacuum distillation systems that use a fractionation means, such as a bubble plate tower, a cascade plate tower, or a thin-film column. Generally, these towers or columns fractionate dewatered crankcase drainings of the SAE stock 20 to stock 40 base oil weights into fuel oil, light lubricating oil of the stock 10 variety, heavier lube oil of the stock 20 variety, and a generally useless bottom residue or sludge. In such operations, it is accepted that a good recovery is on the order of 60% light and heavier stocks combined, based on the volume of the dewatered and filtered used oil drainings. Such yields, low when compared to the heavy stock yields of the present invention, cannot be significantly improved upon with the prior art vacuum distillation systems due largely to the fact that they do not eliminate cracking of the drainings stock or coking within the equipment.

Another known rerefining technique precedes such a vacuum fractionation step with a caustic chemical treatment in an attempt to obtain a purer final product and reduce coking and corrosion of the fractionation equipment. Such preliminary chemical treatments do not adequately solve the coking problem; the fractionating equipment still must be periodically shut down for cleaning the internal surfaces thereof. Also, significant cracking of the lube stock remains a problem, generally caused by relatively harsh operating conditions, e.g., heating the stock to at least 675° F. In addition, such prior art operations add the disadvantage of having to safely dispose of large quantities of a sludge that has a strong concentration of caustic chemicals. An example of this latter development is disclosed in Chambers, U.S. Pat. No. 3,625,881.

Another vacuum distillation process for rerefining used petroleum products is disclosed in Fitzsimons, et al., U.S. Pat. No. 3,791,965. This reference teaches a combined flash distillation and multistage stripping operation, followed by one or more flash vacuum distillations. Fitzsimons, et al do not solve the problem of coking and fouling since, inter alia, they rely upon the gravity-fed passing of the used oils across a heated surface, for example, during the multistage stripping operation. Such a passing directly causes coking on the heated surface, requiring a periodic shutdown of the rerefining operation to effect a cleaning of the apparatus.

Generally, all prior art vacuum distillation processes utilized to rerefine used lubrication oil drainings require frequent cleaning. In most cases certain portions should be cleaned as often as every two weeks of operation, thereby severely lessening the commercial efficiency and usefulness of such processes. These prior art processes also produce significant quantities of a valueless sludge by-product that is difficult to dispose.

It is acccordingly an object of the present invention to provide an improved method and means for continuously and efficiently rerefining used lubricating oil stocks.

A further object of this invention is an improved method and means for rerefining used lubricating oils which deodorizes the feed stock by removing mercaptans therefrom, removes water from the feed stock, produces a light, fuel oil byproduct, reduces the acidity of the feed stock to help reduce corrosion, and removes $NO_x$ gases from the feed stock to reduce fouling.

An additional object of this invention is an improved method and means for rerefining used lubrication oil stocks into high quality lubricating oil.

Still another object of the present invention is the production of a rerefining by-product that is a highly viscous petroleum concentrate possessing an advantageously low vapor pressure.

Another object of the invention is an improved method and means for rerefining used lubricating oil stocks with a minimum of coking, fouling, corrosion, and cracking, the invention including an extremely low pressure, high vacuum distillation.

Yet another object of the present invention is an improved method and means whereby used lubricating oil is rerefined in a continuous manner and at a steady and relatively fast flow rate.

One further object of the invention is an improved method and means for rerefining used lubricating oil which minimizes the amount of useless sludge produced, the amount of labor expended, and the amount of materials used therein, such as clay, acid, caustic, and other chemicals.

An additional object of this invention is an improved method and means for rerefining used lubricating oil without destroying or substantially damaging various costly additives and beneficial additive packages present in the used oil stock.

The method and apparatus of this invention provide for a moderate temperature, long time predistillation of a used lubricating oil stock, followed by a moderate temperature, very low pressure vacuum distillation to separate a purified lubricating oil from a concentrate product of heavy lube hydrocarbons and petroleum stock additives. The moderate temperatures are below the cracking temperature of the particular stock that is processed.

Additional objects, if not set forth specifically herein, will be readily apparent to those skilled in the art from the detailed description of the invention which follows and from the drawings in which:

FIG. 2 is a flow diagram depicting details of Example I herein.

FIG. 3 is a flow diagram depicting details of Example II herein.

Figure 1:
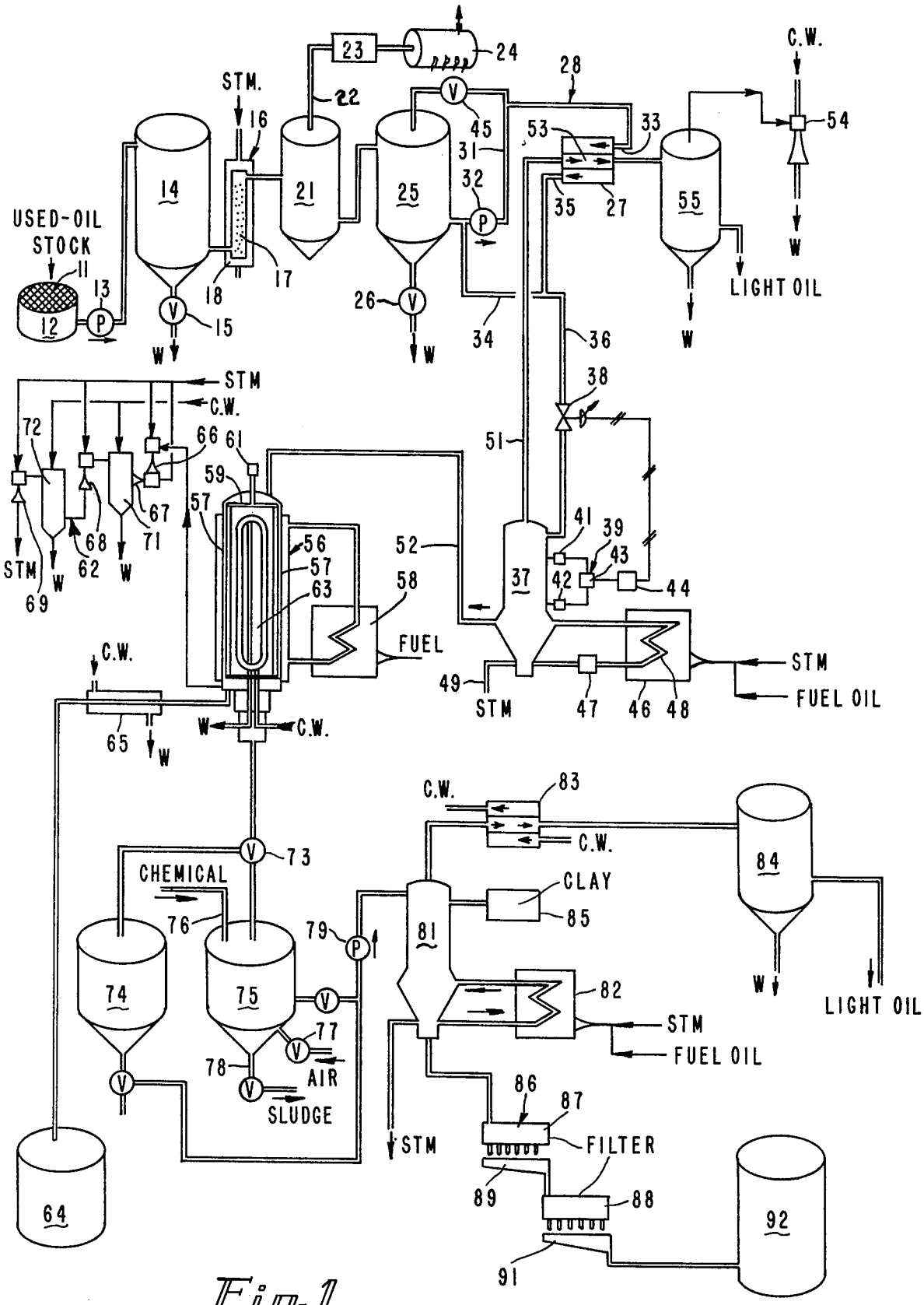
FIG. 1 is a schematic illustration of the apparatus of this invention.

Generally, the method of this invention includes the following steps for treating used lubricating oil stocks which are often collected as drainings from the crankcases of diesel, internal combustion, and other types of engines. Such used oils usually lie within or between the stock 20 to stock 40 weights since these are commonly used in the engines of automobiles, trucks, railway locomotives, and the like.

The used lubricating oil stock is predistilled, preferably by being steam stripped for several hours, at a temperature below its cracking temperature to remove a light oil therefrom. The predistilled stock is then vacuum evaporated at a temperature below the cracking temperature of the stock. The preferred vacuum evaporation step includes forming a thin film of the predistilled stock upon a heated surface that is within a very low pressure environment, constantly wiping the surface to maintain a thin film of stock, and separating the predistilled stock into a lubricating oil and a viscous concentrate of heavy lube hydrocarbons and additives. The separation is accomplished due to the fact that the lubricating oil evaporates on the heated surface and the viscous concentrate does not evaporate under these conditions. The evaporated lubricating oil may then be subjected to further purification, if desired.

More particularly, the present method, including a detailed description of the essential steps and of the optional steps, can be described as follows.

A used lubricating oil stock of engine drainings or the like is passed through a screen having a size on the order of a 10-mesh Tyler sieve size to remove large solid impurities. The screened stock is then passed into a storage zone where some of the nonmiscible, heavy impurities such as water are drained from the stock. The screened and drained stock is then removed from this zone for further treatment.

Primarily as a safety precaution, it is preferred that the stock be flashed at a relatively low temperature and with a very short dwell time to devolatilize it. More specifically, the stock is passed through a heated column to raise the temperature of the stock to about 150°-200° F. (approximately 65°-95° C.). The heated stock is then flashed to vaporize and remove low boiling point hydrocarbon impurities, such as gasoline. The flashed gasoline or the like is ejected from the stock and then incinerated. Preferably, the flashed and ejected impurities are water scrubbed prior to incineration.

The thus devolatilized stock then passed into a feed stock holding zone. If desired, further water or other non-miscible impurities can be drained from the stock at this point. The stock is removed from this holding zone and can then be preheated to about 250°-350° F. (approximately 120°-175° C.).

Next, the stock is predistilled, preferably by being steam stripped. In the preferred method, predistillation proceeds at a flow rate of roughly 20-30 gallons of stock per minute. The predistillation is carried out to subject the stock to distillation conditions for at least 4 hours, usually for about 300 minutes. The distillation time can vary somewhat depending upon the properties of the stock and will generally be in the range of about 240 to 500 minutes. The distillation pressure is substantially atmospheric and can be slightly greater, e.g. 5 psig. When steam stripping accomplishes the predistillation, the stripping steam will usually be saturated and at an initial pressure of about 10-50 psig. and pass up through the heated stock, resulting in the vaporization and separation of a light oil from the oil stock to form a predistilled heavier oil stock, which predistilled stock is then vacuum distilled as described hereinafter. Throughout the predistillation step, the temperature of the stock is kept below its cracking temperature, and usually within the range of about 480°-650° F. (approximately 249°-345° C.). For example, a cracking temperature for a typical SAE stock 40 feed stock is about 660° F., and that for a typical SAE stock 20 feed stock is about 612° F.

This predistillation step not only vaporizes and removes substantial quantities of a useful light oil, but it also vaporizes and removes residual water within the stock. The predistillation step also deodorizes the feed stock primarily by its significant reduction in the sulfur content, generally 1.0 to 1.5%, of the feed stock to as low as 0.54% of the predistilled stock. Likewise, this predistillation reduces the acidity of the feed stock from a total acid number of about 3.3 to an acid number of approximately 1.3. Predistillation further reduces fouling by removing $NO_x$ gases which are known to induce the formation of tar in oils.

The light oil separated from the oil stock during the predistillation step usually has a viscosity of about 50-56 SSU at 100° F. (about 38° C.) and is useful as a fuel. In the preferred method, it is collected at a flow rate of roughly 4-6 gallons per minute, liquid equivalent. It is preferred that this light oil be used as a fuel in the system itself and as a fuel for operations attendant to the system, such as for heating offices and the like. Before this light oil is used as a fuel, it is preferred that it be separated from any steam vapor with which it may have been drawn off during the predistillation step. The combined light oil vapor and steam vapor are cooled to about 250°-350° F. (approximately 120°-175° C.). The thus cooled vapors are "pulled" by a water eduction operation which maintains a weak vacuum of about 1-2 pounds. The "pulled" vapors are permitted to condense, whereupon water is drained from the light oil.

The predistilled stock is then subjected to a vacuum distillation at a high vacuum, a moderate temperature, and in the preferred method at a feed rate of approximately 15-25 gallons per minute. Preferably, this is accomplished by forming a thin film of the predistilled stock on a surface that is continuously wiped so as to maintain the thin film and to assist in preventing coking on the surface. The surface is within a high vacuum, or low pressure, environment and effects a heating of the predistilled stock to below its cracking temperature, which as discussed elsewhere herein is usually in the range of about 480°-650° F. (approximately 249°-345° C.). Under these conditions, the lubricating oil in the predistilled stock is vaporized, while the heavier lube hydrocarbons, additives and the like, collectively termed the "concentrate" product of this invention, do not vaporize. The concentrate is preferably cooled and then collected as a useful by-product. The vacuum distilled lubricating oil vapor preferably is condensed and collected at a flow rate of approximately 14-22 gallons per minute in the preferred method. This lubrication oil is pure enough for many lubrication uses, but it may be subjected to further purification steps discussed hereinafter.

The vacuum distillation step achieves an especially high vacuum (0.1 to 2 mmHg of pressure), whereby superior separation of the "concentrate" from the lubrication oil can be accomplished even at the moderate, sub-cracking temperature range of 480°-650° F. This low pressure, moderate temperature feature is made possible primarily because the stock had been previously predistilled. Were it not for the previous predistillation, the vacuum pulling means utilized would not be able to achieve a vacuum of this magnitude, since it would also have to pull off the light oil. Such light oil is no longer within the stock which has been predistilled according to the present process.

Because the temperature is kept below the cracking range throughout the present method, especially high yields of heavy lubrication oil are realized by minimizing any breakdown of the lubricating oil stock into lighter fractions. This feature also results in a saving of energy, since the temperature need not be raised to relatively high temperatures, the above-cracking temperatures. It likewise assists in reducing coking, fouling, corrosion, and scale formation in the tubes of the equipment used, as well as post-distillation tar deposits by the distilled stock. Such tar deposits are generally believed to be caused by the breakdown of original lubricating oil additives at temperatures of about 700° F. (about 371° C.) and above, as used in the prior art. Since the breakdown of additives is avoided in the present process, the additives are available to inhibit the formation of deposits. Also, it is believed that $NO_X$ gases catalytically induce tar formation. This undesirable result is avoided since the $NO_x$ gases had been removed during the predistillation step.

Depending upon the used oil stock being processed and the desired qualities of the rerefined oil, an optional chemical treatment step can next be accomplished. In this step, the vacuum-distilled oil stock is preferably contacted with concentrated 66° Be (98%) sulfuric acid in order to improve the oxidation stability of the oil and to precipitate a chemically impregnated sludge which is then disposed of. Generally, this sludge includes barium and calcium impurities that are precipitated as sulfates during the chemical treatment step. Of course, other strong acids or bases can be added to accomplish this chemical treatment.

The amount of chemical needed to treat the predistilled and vacuum distilled stock at this stage of the process is considerably less than amounts traditionally needed for chemical treatments of used lubricating oil stocks. For example, the preferred selective acid treatment of this optional step utilizes only about 10% of the acid needed in a traditional acid treatment of essentially raw used oil stock. Likewise, the amount of the acid impregnated sludge that must be properly disposed of is only about 10% of the amount of sludge formed in a traditional acid treatment. One manner of properly disposing of an acid sludge is to neutralize it with, for example, lime and use the neutralized sludge as a landfill. If such an operation is performed, only a small amount of lime likewise will be needed. As a general rule, when the vacuum distilled oil stock is to be utilized as an automobile motor oil and not as a railway journal box oil, it preferably should be chemically treated.

Next, the vacuum distilled stock may be distilled again, this time while being contacted with a clay. The clays used are those known to be oil clarifying clays and may be either acid activated or neutral. It is preferred that the clays be added in oil slurry form to promote ease of mixture with the oil stock. This optional step further cleans, clarifies, deodorizes, and lowers the acid value of the stock. The distillation also can be used to adjust the oil stock to a desired viscosity. This step is generally within the temperature range of 480°-600° F. (approximately 249°-315° C.), particularly if the clay is acid activated. If the clay utilized is neutral it is possible for the clay contacting to be carried out at temperatures as low as 250°-300° F. (approximately 120°-150° C.). The clay distilled oil stock is condensed in much the same manner as had been accomplished in the predistillation step.

Due to the fact that the stock previously processed according to this invention is lighter in color (e.g. ASTM 4½ to 5½) than stock at the clay-contact stage of traditional processes (e.g. ASTM 7½ to 8), less clay is expended per volume of stock by this invention. For example, a representative amount for the present process is about 0.15 pounds of clay per gallon of clay-contacted automotive crankcase drainings stock, while that for a traditional process is on the order of 0.5 pounds of clay per gallon of automotive crankcase drainings stock.

When the lubricating oil stock is clay distilled, it is next cooled to below 300° F. (approximately 150° C.) and filtered, primarily for the purpose of removing any residual clay. Usually, the filtration is accomplished by a pressurized passing of the oil through a filter medium to complete the rerefining of a used stock into a high quality lubricating oil. The rate of filtration is generally greater than that possible in traditional processes. The filtration rate of stock 40 oil produced by the preferred method is approximately 5 gallons per hour per square foot of filter surface under a vacuum of about 20-22 inches Hg (approximately 505-560 mmHg) and at an oil temperature of about 90°-110° C. If desired, any type of additives or additive "package" for lubricating oils may be added to impart further desirable properties to the rerefined oil.

The concentrate product of this invention is a by-product formed during the vacuum distillation step of the present method. It includes the heavy lube hydrocarbons, additives, metals, metal compounds, and the like, that are present in used lubricating oil drainings stocks before they are processed. The concentrate product, even without any further modification thereof, is useful as a lubrication grease that is very viscous and has an extremely low vapor pressure; it is, therefore, a superior high-temperature grease that will not vaporize even when subjected to extremely high temperatures.

More particularly, the present concentrate product exhibits a vapor pressure within the range of 0.1 to 2.0 mmHg at temperatures between about 480° to 650° F. (approximately 249° to 345° C.), the flash point being generally in excess of 650° F. The concentrate product generally will have a viscosity within the approximate range of 4,000 to 12,000 SUS at 210° F. when produced from stock 40 drainings and a viscosity within the general range of 6,000 to 20,000 when produced from stock 20 drainings, the respective Brookfield viscosities at 210° F. being 1200 CPS and 2650 CPS (#3 spindle, 50 rpm). The penetration rating at 77° F. (ASTM D217) for a typical concentrate product will generally vary between 320 to 360 units. The concentrate has a deep rich black color and is odorless at room temperature. Its pour point is generally within the range of 15°-20° F. The ash content will be about 12-14% from the stock 20 source and about 5-6% from a typical stock 40 source. A stock 20 concentrate product will typically exhibit a carbon residue (ASTM D189) of 24%, while that of a stock 40 concentrate will be about 20%. The concentrate product from particular stock 20 drainings had a sulfur content of 1.30 and a pH of 6.2; that from a particular stock 40 drainings contained 1.61% sulfur and had a pH of 7.6.

Various superior properties of the concentrate product are believed to be due in large measure to the combination of components present within the concentrate product. Such components include very heavy lube fractions as well as generally advantageous and expensive additives and additive packages themselves often present in used oil stock drainings, many of which remain undamaged and substantially unaltered during the method of the present invention. These would have been destroyed, discarded, or substantially damaged in prior art methods.

With a flash point of over 650° F. and vapor pressure usually of less than 1 mmHg, at a temperature of about 500° F. (approximately 260° C.), the concentrate product makes a very effective base for high temperature and extreme pressure lubricants. Its viscous properties resist wiping action of sliding surfaces very effectively, even under very heavy loads. It is very water-resistant and possesses natural anti-rust properties. Its wetability is excellent. It cuts back readily with petroleum solvents, making it easily adaptable to spray or aerosol applications.

The concentrate product often also contains the following materials which provide various additional benefits. Zinc contributes to oxidation stability, water repellancy, anti-wear and anti-seize properties. It also provides anti-rust properties. It may act in conjunction with phosphorus in providing these benefits, useful in open gear lubricants, wire rope lubricants and tool joint compounds. Copper, aluminum, molybdenum, titanium serve as fillers that improve plasticity, reduce friction and provide anti-seize and anti-weld protection. They may be useful in tool joint and pipe thread lubricants, high temperature applications, or as friction modifiers in drawing compounds. Barium and calcium are detergent and dispersant additives. They are found in the concentrate and contribute to wetability and anti-rust properties. They are basic in make-up and will help control acidity in oil, grease and gear oil formulas. Nickel, chromium, iron, silver, manganese and tin may be present as oxides or soaps. As such, they improve lubricity, reduce rusting and improve corrosion resistance in grease type preparations. Lead in grease and oil type preparations imparts extreme pressure, anti-wear, anti-rust and anti-seize properties to the lubricant. It may be present as an oxide or a naphthenate. It aids in reducing scuffing and scoring on heavily loaded gears or bearing surfaces. Phosphorus imparts extreme pressure and anti-wear properties to lubricants. It may be combined with zinc or sulfur to achieve this action.

Some representative uses of the concentrate product are: high temperature kiln lubricants, oven conveyor lubricants, iron ore pelletizing, grate and side bar lubricants, open gear grease, fifth wheel grease, shovel stick grease, walking cam lubricant, traction motor grease, bentone, lithium and aluminum grease ingredient, rust preventives, automotive undercoating, tool joint compounds, aerosol spray coatings, paint coloring, carbon source in foundry binders and sealants, sealant for roadways, binder for carbon electrodes, ingredient in metal forming and drawing compounds, and extrusion lubricants.

The present apparatus, including essential and optional structure, is depicted in FIG. 1. The apparatus is capable of processing used stocks at the flow rates disclosed herein.

The used lubricating oil stock preferably is first drained through a screen 11 into a storage tank 12, from which it is transferred by a pump 13 or the like, into a holding tank 14. Settled water may be drained from the bottom of the tank, the rate of drain being controlled by valve 15, which is preferably a gate valve. The oil stock in tank 14 is passed to a heat exchanger means, generally indicated by reference numeral 16. Preferably, means 16 is of the fin-tube type in which the oil passes through a tube 17 surrounded by a steam jacket 18.

Downstream of the heat exchanger means 16 is a flash tank 21. The flash tank 21 is basically a compartment through which the heated oil stock quickly flows and has a gas ejection line 22 in the top end thereof. Ejected gases then pass through a water scrubber 23 and into an incinerator 24.

The flow of the thus devolatized oil stock then proceeds from flash tank 21 into feed tank 25 which has a structure similar to that of holding tank 14. Any settled water may be drained from the bottom thereof by valve 26, which is preferably a gate valve. The stock proceeds to a conventional heat exchanger 27 by way of a conduit means, generally indicated by reference numeral 28. The preferred conduit means 28 effects a recirculation of overflow stock and includes a conduit 31 connecting the feed tank 25, through circuit pump 32, to an inlet 33 of heat exchanger 27. Means 28 further includes another conduit 34 connecting heat exchanger outlet 35 with pump 32 at its inlet end and also with feed tank 25.

A further conduit 36 communicates distillation still 37 with conduit 34 and hence with outlet 35. In the preferred apparatus, a pneumatic control valve 38 regulates the flow of stock through conduit 36. Valve 38 is pneumatically controlled by a differential pressure control means, generally indicated by reference numeral 39. Means 39 includes pressure level sensors 41, 42 for detecting the static pressure of stock at two levels within still 37. The pressure difference is recognized by a differential pressure transmitter 43, which transmits this difference to a cell 44 for pneumatically activating valve 38. Valve 38 in turn regulates the amount of stock flowing into still 37, and is generally set within the preferred flow rate of about 20–30 gallons of stock per minute.

Stock that does not pass through valve 38 and into still 37 will be diverted through conduit 34, for flow into feed tank 25, pump 32, or both. Any stock flowing through pump 32 can then be directed to heat exchanger 27 or, if desired, returned to feed tank 25 by the opening of valve 45, which is preferably a gate valve.

The still 37 is of conventional construction. It preferably includes a furnace 46 which may be of the tube-still, firebox type. Furnace 46 utilizes a fuel oil flame in conjunction with a fluid circulation means 47, such as a pump, for rapid circulation (on the order of 15 feet per second or more) of the stock through the hot tubes 48 to minimize coking within the tubes 48 and reduce fouling in general. The preferred still 37 also includes steam stripping means 49 which passes steam at an initial pressure of 15–50 psig up through the heated oil within the still, resulting in the separation of light oil vapors which are drawn off, along with excess stripping steam, from the top of the still 37 through a conduit 51. Meanwhile, the predistilled heavy lubrication-type oil stock flows from the still 37 through conduit 52.

The conduit 51 directs the light oil vapor and steam vapor to an internal section 53 of heat exchanger 27, wherein heat from said vapors is passed to the oil stock flowing between inlet 33 and outlet 35 to effect a preheating thereof while simultaneously effecting a cooling and condensing of the vapors. The drawing of light oil vapor and steam through section 53 preferably proceeds at a flow rate of about 4–6 gallons per minute of light oil and about 1-3 gallons per minute of water and is accomplished by means of a water eductor unit 54 which maintains a weak vacuum of about 1-2 pounds and eventually draws the vapors and steam into a separator unit 55 where the light oil is further condensed and separated from condensed steam and other water.

Conduit 52 preferably directs predistilled stock at a rough feed rate of 15-25 gallons per minute into a vacuum evaporator, which is generally indicated by reference numeral 56 and is preferably of the "wiped film" type. Evaporator 56 is basically a still that has means for distilling an oil stock under a high vacuum, and below the cracking temperature of the stock. The preferred evaporator includes a vertical cylindrical wall 57 that is heated by the condensing of vaporous heating medium such as "Dowtherm A". The heating medium is being heated to roughly 650°-710° F. (343°-377° C.) in a boiler 58. (Dowtherm is a trade name of a heat transfer media manufactured by the Dow Chemical Company. It is used as a heat transfer media in the same general way as steam, but offers the advantage of lower pressure at the given temperature. The vapor pressure of "Dowtherm A" at 710° F. is about 99.5 psig whereas the pressure of saturated steam at the same temperature is over 3000 psig.)

Wall 57 is constantly wiped by rotating blade means 59. Rotation of means 59 is effected by a motor 61, or similar means. The vacuum or lower pressure condition within evaporator 56 is supplied by a steam ejector system, generally referred to by reference numeral 62. Condensation of the lubricating oil stock that is vaporized in evaporator 56 is accomplished by an internal condensation means 63 through which cold water is circulated. The concentrate product collected from wall 57 is transferred to a concentrate storage tank 64, preferably after having been cooled by a water jacket 65.

The preferred steam ejector system 62 is a four-stage, steam-jet ejector system that operates as a vacuum pump of moderate size and capacity. Preferred system 62 includes four steam eductors, 66, 67, 68, 69, and two internal barometric condensers 71, 72. A first steam eductor 66 is in communication with the evaporator 56 and with a second steam eductor 67 which communicates with a first cold water condenser 71 for condensing and thus greatly decreasing the volume of steam passing through eductors 66 and 67, causing a first and a second stage evacuation of gases, primarily air, from evaporator 56. A third-stage ejection is accomplished by a third steam eductor 68 and a second cold water condenser 72. Fourth stage steam eductor 69 ejects non-condensable gases such as tramp air to the atmosphere.

Condensed lubricating oil stock flows through valve 73, which is preferably a two-way gate valve. Valve 73 either directs the stock flow (about 14-22 gallons per minute in the preferred apparatus) to storage tank 74 or to chemical treatment tank 75.

Chemical treatment tank 75 includes a conduit 76 for adding a strong chemical to the condensed oil stock and a valve 77 to introduce agitating air into the tank 75. The sludge formed and settled within tank 75 is removed through conduit 78. Tank 75 is in communication with a transfer pump 79 which transfers either some condensed lube stock from tank 74 or the chemically treated condensed lube stock from tank 75 into clay contact still 81.

Clay contact still 81 is basically of the same construction as the preferred distillation still 37 and includes a furnace 82 and a light oil condensor 83 and a separator tank 84. Still 81 also includes a clay addition means 85 of conventional construction for adding a clay-oil slurry into still 81.

A filtration means, generally indicated by reference numeral 86, communicates with still 81. Means 86 effects a final clarification of the rerefined lubricating oil stock. The preferred means 86 includes a two-stage filter system, being primarily two filter presses 87, 88, which are of conventional construction and include means (not shown) for passing the stock through a filter paper positioned over a filter screen. The filtered stock is collected in bin 89, and then in bin 91 which is in communication with a storage tank 92 for collecting the filtered, rerefined product.

The following Examples are set forth as illustrative embodiments of the method and are not to be taken in any manner as limiting the scope of the invention which is defined by the appended claims.

EXAMPLE I

A specific example of the method of this invention as it has been run on the preferred apparatus is illustrated in the flow chart of FIG. 2. The used oil stock of this example was from automotive crankcase drainings generally of the SAE stock 20 grade. The 10,000 gallons of vacuum distilled stock, which had not been subjected to either a chemical treatment step, a clay contact distillation step, or a filtration step, exhibited a viscosity of 250 SUS at 100° F. and 50 SUS at 210° F. Its viscosity index was found to be 103. The amount of this vacuum distilled stock, 10,000 gallons, represented a recovery from the predistilled stock of about 91 volume percent, while the recovery of concentrate product, 990 gallons, was about 9 volume percent of the predistilled stock.

The 9420 gallons of rerefined oil, after having been subjected to the full preferred process and without incorporating any additives, had a viscosity of 281 SUS at 100° F. and 51.45 SUS at 210° F. with a viscosity index of 99. The 990 gallons of concentrate product exhibited a viscosity of 10,000 SUS at 210° F. The yield of the stock 20 rerefined lubricating oil was about 94 volume percent of the vacuum distilled stock, about 85.7 volume percent of the predistilled stock, and about 63.6 percent of the screened and drained stock, minus its initial water ("from wet oil") content of 406 gallons.

EXAMPLE II

Another example of the method of this invention is depicted in FIG. 3. This example was run on the apparatus as described herein, and included the optional acid treatment step. The stock was from diesel engine crankcase drainings which are of a heavy grade, SAE stock 40. The 7010 gallons of stock as processed immediately after vacuum distillation had a viscosity of 820 SUS at 100° F. The concentrate product removed by this vacuum distillation had a viscosity of 5,000 SUS at 210° F. After acid treatment, clay contact distillation, and filtration, the 6,000 gallons of rerefined oil product, without the addition of any additives, had a viscosity of 882 SUS at 100° F. and 75 SUS at 210° F., with a viscosity index of 74. The yield of this stock 40 rerefined product was about 84.5 volume percent of the vacuum distilled stock, about 78 volume percent of the predistilled stock, and about 65.2 volume percent of the screened and drained stock, minus the initial water ("from wet oil") content of 195 gallons.

EXAMPLE III

A spectrographic analysis of typical concentrate products prepared by the present method was conducted. The results were as follows:

| | From Stock 20 Drainings (ppm) | From Stock 40 Drainings (ppm) |
|---|---|---|
| Gold | 0 | 0.1 |
| Zinc | 3500 | 130 |
| Copper | 160 | 190 |
| Aluminum | 230 | 30 |
| Barium | 1400 | 0 |
| Nickel | 10 | 0 |
| Chromium | 100 | 200 |
| Calcium | 7000 | 25,000 |
| Iron | 2000 | 500 |
| Silver | 550 | 170 |
| Tin | 140 | 10 |
| Lead | 15,000 | 1200 |
| Phosphorus | 2000 | 0 |
| Boron | 10 | 150 |
| Magnesium | 1300 | 170 |
| Vanadium | 0 | 0 |
| Molybdenum | 10 | 0 |
| Manganese | 70 | 0 |
| Cadmium | 0 | 0 |
| Titanium | 70 | 0 |

Obviously, many modifications and variations of the invention as hereinbefore set forth may be made without departing from the spirit and scope thereof, and only such limitations should be imposed as are indicated in the appended claims.

We claim:

1. A method for rerefining used lubricating oils, comprising the steps of: predistilling a used oil stock by steam stripping said stock within the range of between about 480° F. and about 650° F. and below the cracking temperature thereof for at least 4 hours, said predistilling step removing $NO_x$ gases, a light oil component and residual water from the stock to leave a predistilled stock; thereafter vacuum distilling the predistilled stock at below the cracking temperature thereof in a high vacuum environment, said vacuum distilling step including forming a thin film of the predistilled stock on a heated surface and wiping said film to assist in evaporating the stock and to avoid coking, fouling and buildup of impurities, and said vacuum distilling step including vaporizing a vacuum distilled stock to separate it from a viscous concentrate.

2. The method of claim 1 wherein said high vacuum environment is within the range from about 0.1 to about 2.0 mm Hg.

3. The method of claim 1 wherein said predistilling temperature and said vacuum distillation temperature are each within the range of about 480° F. to about 650° F.

4. The method of claim 1 wherein said predistilling is carried out at approximately atmospheric pressure.

5. The method of claim 1 further comprising distilling said vacuum distilled stock in the presence of a clay, filtering the clay distilled stock; and collecting the filtered stock.

6. The method of claim 1 further comprising treating the vacuum distilled stock with a strong acid or base to form and remove a sludge therefrom; distilling the chemically treated stock in the presence of a clay; filtering the clay distilled stock; and collecting the filtered stock.

7. The method of claim 1 wherein said predistilling step is preceded by a flashing step including heating the stock to approximately 100–200° F., permitting materials volatile at this temperature to expand to gases, and collecting and incinerating said gases.

8. The method of claim 1, further comprising collecting said separated viscous concentrate as a useful byproduct having a very low vapor pressure.

9. A viscous concentrate formed by the steps of: predistilling a used lubricating oil stock by steam stripping said stock at a temperature between about 480° F. and about 650° F. and below the cracking temperature thereof for at least 4 hours, said predistilling step removing $NO_x$ gases, a light oil component and residual water from the stock to leave a predistilled stock; thereafter vacuum distilling the predistilled stock by forming a thin film of the predistilled stock on a heated surface and wiping said film to assist in evaporating the stock and to avoid coking, fouling and buildup of impurities, said vacuum distilled taking place below the cracking temperature of the predistilled stock in a high vacuum environment, whereby a viscous concentrate is formed and removed from a vaporized, vacuum distilled stock; and collecting said viscous concentrate.

10. The viscous concentrate of claim 9 wherein said concentrate is an anti-corrosion concentrate suitable for coating vehicle frames and the lubricating oil stock contains heavy lube hydrocarbons, additives and metal compounds.

11. The concentrate of claim 10 wherein the additives and metal components remain substantially unaltered during the processing steps.

12. The anti-corrosion concentrate of claim 10 wherein the concentrate has a viscosity within the range of 4,000 to 20,000 SUS at 210° F.

13. The anti-corrosion concentrate of claim 10 in diluted form with a petroleum solvent making it easily adaptable to spray or aerosol applications.

* * * * *